US007552899B2

(12) United States Patent
Chen et al.

(10) Patent No.: US 7,552,899 B2
(45) Date of Patent: Jun. 30, 2009

(54) SLIDE BRACKET ALLOWING FRONT ACCESS FOR DISMOUNTING

(75) Inventors: Ken-Ching Chen, Kaohsiung Hsien (TW); Shih-Long Huang, Kaohsiung Hsien (TW); Shun-Ho Yang, Kaohsiung Hsien (TW); Chun-Chiang Wang, Kaohsiung Hsien (TW)

(73) Assignee: King Slide Works Co., Ltd., Kaohsiung Hsien (TW)

( * ) Notice: Subject to any disclaimer, the term of this patent is extended or adjusted under 35 U.S.C. 154(b) by 299 days.

(21) Appl. No.: 11/581,431

(22) Filed: Oct. 17, 2006

(65) Prior Publication Data

US 2008/0087781 A1 Apr. 17, 2008

(51) Int. Cl.
*A47B 88/00* (2006.01)

(52) U.S. Cl. ..... 248/224.8; 248/220.21; 248/243; 312/334.4; 211/26

(58) Field of Classification Search ..... 248/224.8, 248/220.21, 221.11, 243, 244, 245, 246, 248/220.22, 220.31, 222.52; 312/265.1, 312/334.4, 223.2, 334.5, 223.1; 211/208, 211/192, 26; 361/725, 826
See application file for complete search history.

(56) References Cited

U.S. PATENT DOCUMENTS

| | | | | |
|---|---|---|---|---|
| 3,055,462 | A * | 9/1962 | Steele | 403/18 |
| 5,571,256 | A | 11/1996 | Good et al. | |
| 5,791,498 | A | 8/1998 | Mills | |
| 5,833,337 | A | 11/1998 | Kofstad | |
| 6,021,909 | A | 2/2000 | Tang et al. | |
| 6,070,957 | A | 6/2000 | Zachrai | |
| 6,230,903 | B1 | 5/2001 | Abbott | |
| 6,269,959 | B1 | 8/2001 | Haworth | |
| 6,422,399 | B1 | 7/2002 | Castillo | |
| 6,431,668 | B1 | 8/2002 | Reddicliffe | |
| 6,442,030 | B1 | 8/2002 | Mammoser et al. | |
| 6,554,142 | B2 | 4/2003 | Gray | |
| 6,659,577 | B2 | 12/2003 | Lauchner | |
| 6,666,340 | B2 | 12/2003 | Basinger et al. | |
| 6,681,942 | B2 | 1/2004 | Haney | |
| 6,702,124 | B2 | 3/2004 | Lauchner et al. | |
| 6,726,164 | B1 | 4/2004 | Baiza et al. | |
| 6,749,275 | B2 | 6/2004 | Cutler et al. | |
| 6,773,080 | B2 | 8/2004 | Chen et al. | |
| 6,840,388 | B2 | 1/2005 | Mayer | |

(Continued)

FOREIGN PATENT DOCUMENTS

| | | |
|---|---|---|
| TW | M281520 | 12/2005 |

(Continued)

*Primary Examiner*—Anita M King
(74) *Attorney, Agent, or Firm*—Rosenberg, Klein & Lee

(57) ABSTRACT

A slide bracket allowing front access for dismounting includes an end plate disposed to the bracket, suspension blocks disposed on the end plate, and a retaining member provided on the bracket. The end plate has a front part and a rear part opposite to each other. The retaining member has a locating end facing in the direction of the rear part of the end plate to execute resilient motion. A limiting member is provided at the rear part of the end plate. A slot is disposed in the front part of the end plate to connect through the locating end of the retaining member. A releasing member passes through the slot to execute trigger operation against the locating end of the retaining member.

7 Claims, 8 Drawing Sheets

U.S. PATENT DOCUMENTS

| | | | | |
|---|---|---|---|---|
| 6,866,154 | B2 | 3/2005 | Hartman et al. | |
| 6,871,920 | B2 | 3/2005 | Greenwald et al. | |
| 6,891,727 | B2 | 5/2005 | Dittus et al. | |
| 6,926,378 | B2 | 8/2005 | Greenwald et al. | |
| 6,929,339 | B1 | 8/2005 | Greenwald et al. | |
| 6,930,886 | B2 | 8/2005 | Velez et al. | |
| 6,948,691 | B2 | 9/2005 | Brock et al. | |
| 6,974,037 | B2 | 12/2005 | Haney | |
| 6,988,626 | B2 | 1/2006 | Varghese et al. | |
| 7,012,808 | B2 | 3/2006 | Mayer | |
| 7,093,725 | B2 | 8/2006 | Hartman et al. | |
| 7,357,362 | B2 * | 4/2008 | Yang et al. | 248/221.11 |
| 2004/0016712 | A1 | 1/2004 | Hamilton | |
| 2005/0156493 | A1 * | 7/2005 | Yang et al. | 312/334.5 |
| 2005/0285492 | A1 | 12/2005 | Hu et al. | |
| 2006/0152115 | A1 | 7/2006 | Dubon et al. | |
| 2008/0067907 | A1 * | 3/2008 | Chen et al. | 312/312 |
| 2008/0078899 | A1 * | 4/2008 | Chen et al. | 248/220.21 |
| 2008/0203251 | A1 * | 8/2008 | Chen et al. | 248/200 |

FOREIGN PATENT DOCUMENTS

| | | |
|---|---|---|
| TW | M281525 | 12/2005 |

* cited by examiner

SLIDE BRACKET ALLOWING FRONT ACCESS FOR DISMOUNTING

BACKGROUND OF THE INVENTION (a) Field of the Invention

The present invention relates to a slide bracket, and more particularly, to one allowing front access to release the fixed status of the bracket by inserting a releasing member to penetrate through the front of the bracket.

(b) Description of the Prior Art

The pattern of the adaptation of a slide bracket to facilitate the slide to lock to a metal support is usually seen in a rack-mounted computer system. The design of the slide bracket is comparatively diversified with the current design to address tool-free and fast-dismounting features as taught in U.S. Pat. Nos. 6,659,577 B, 6,891,727 B2, Early Publication No. 2006/0152115 A1, and Taiwan Patent Nos. M281520 and M281525.

However, to all the prior art, the bracket must be removed from the side of the bracket; meaning, the user has to reach into the bracket from the front and then bend his hand to the side of the bracket to release a locking member on conditions that there is not slide or another bracket installed above or below the bracket. Therefore, in case of multiple slides and brackets are installed in a fashion close to one another, those slides and brackets located to the bracket to be removed must be dismounted to spare some room sufficient for the removal of the target bracket making the work rather inconvenient and tedious.

SUMMARY OF THE INVENTION

The primary purpose of the present invention is to provide a slide bracket that permits front access for the mounting and dismounting by simply inserting a releasing member to put through the front of the bracket to solve the problem of direct removal of the slide and bracket when multiple slides and brackets are disposed close to where above and/or below the bracket to be removed as found in the prior art.

To achieve the purpose, the present invention includes an end plate, a retaining member, a limiting member and a releasing member. The end plate has a front part and a rear part opposite to each other, a slot, and suspension blocks connected to the rear part of the end plate. The suspension blocks are disposed on a connection plate. A slot is disposed on the connection plate in relation to the slot of the end plate. The retaining member is flexible and has a locating end facing toward the rear part of the end plate. The limiting member is disposed at the rear part of the end plate. The releasing member has a shank to pass through the slots of the end plate and the connection plate. The terminal of the shank holds against the locating end of the retaining member.

Preferably at least two suspension blocks are provided and a connection plate is disposed between two neighboring suspension blocks.

Preferably the limiting member is disposed on the connection plate in a direction facing the retaining member, and the locating end of the retaining member holds against the limiting member.

Preferably the limiting member is disposed on the end plate in a direction facing the retaining member, and the locating end of the retaining member holds against the limiting member.

Preferably the limiting member is disposed with a hooking part, and the locating end of the retaining member is disposed with a hole to engage the hooking part.

Preferably the retaining member is pivotally connected to the bracket and connected with a resilient member for the retaining member to swing and rebound; alternatively, the retaining member is fixed to the bracket and made flexible for the locating end to execute resilient motion. By comparing with the prior art, the present invention allows easier and faster removal of a single slide adapted with a bracket.

DETAILED DESCRIPTION OF THE PREFERRED EMBODIMENTS

Figure 1:
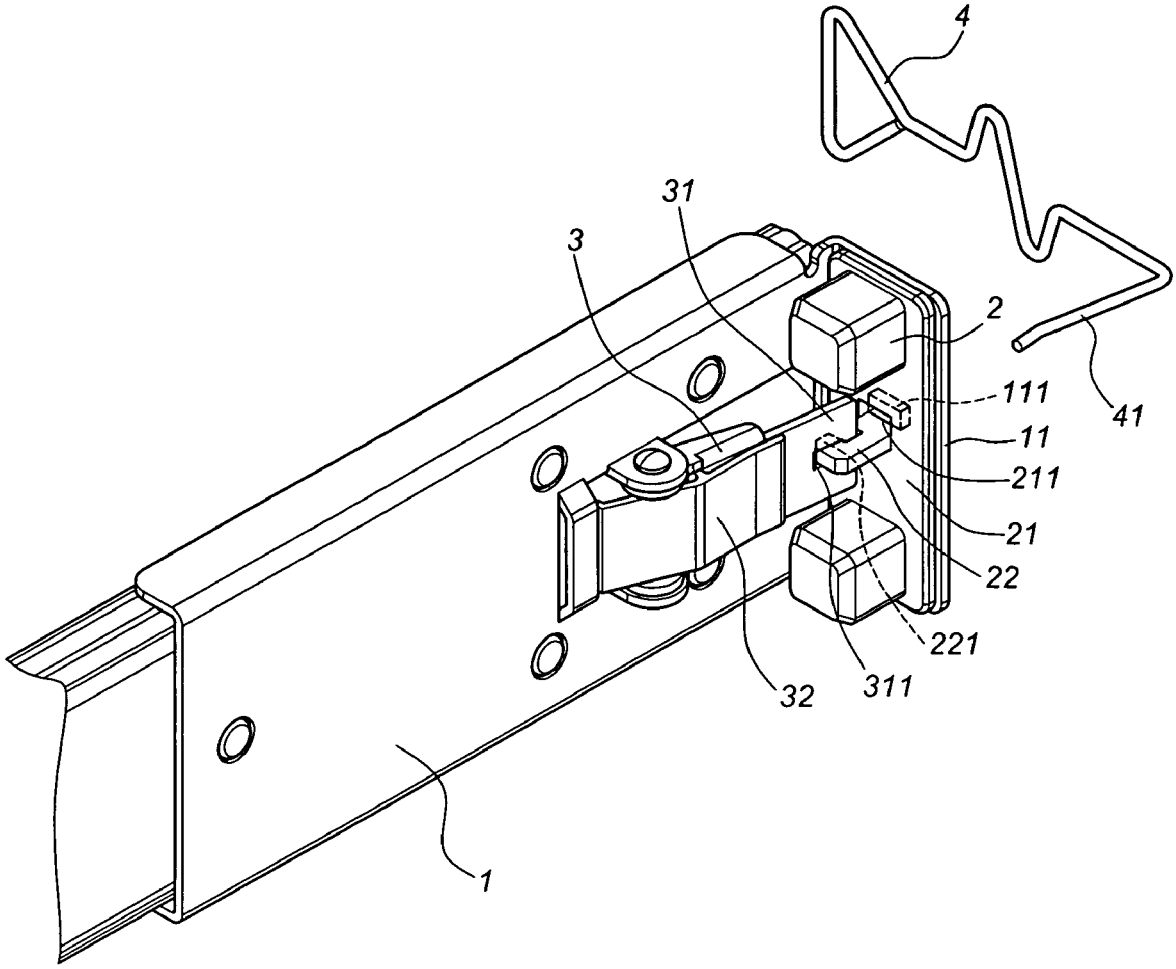
FIG. 1 is a perspective view of a first preferred embodiment of the present invention.

Referring to FIG. 1, a first preferred embodiment of the present invention includes a bracket (1), suspension blocks (2), a retaining member (3), and a releasing member (4).

The bracket (1) is provided with an end plate (11). The end plate (11) has a front part and a rear part opposite to each other. A slot (111) penetrates through the end plate (11). The suspension blocks (2) are connected to the rear part of the end plate (11).

In the preferred embodiment, at least two suspension blocks (2) are provided and a connection plate (21) is provided between two neighboring suspension blocks (2). That is, the suspension blocks (2) are disposed on the connection plate (21). A limiting member (22) is provided on the connection plate (21). The terminal of the limiting member (22) is disposed with a hooking part (221) and a slot (211) penetrates through the connection plate (21) in relation to the slot (111) of the end plate (11).

The retaining member (3) is pivotally connected to the bracket (1). The retaining member (3) has a locating end (31) facing in the direction of the rear part of the end plate (11) and is connected with a sheet resilient member (32) for the retaining member (3) to swing and rebound. The locating end (31) of the retaining member (3) is disposed with a hole (311) to engage the hooking part (221) of the limiting member (22).

The releasing member (4) has a shank (41) passing through the slots (111, 211), and the terminal of the shank (41) holds against the locating end (31) of the retaining member (3). A screwdriver may be deemed as an equivalent to the releasing member (4) for achieving the similar purpose.

Figure 2:
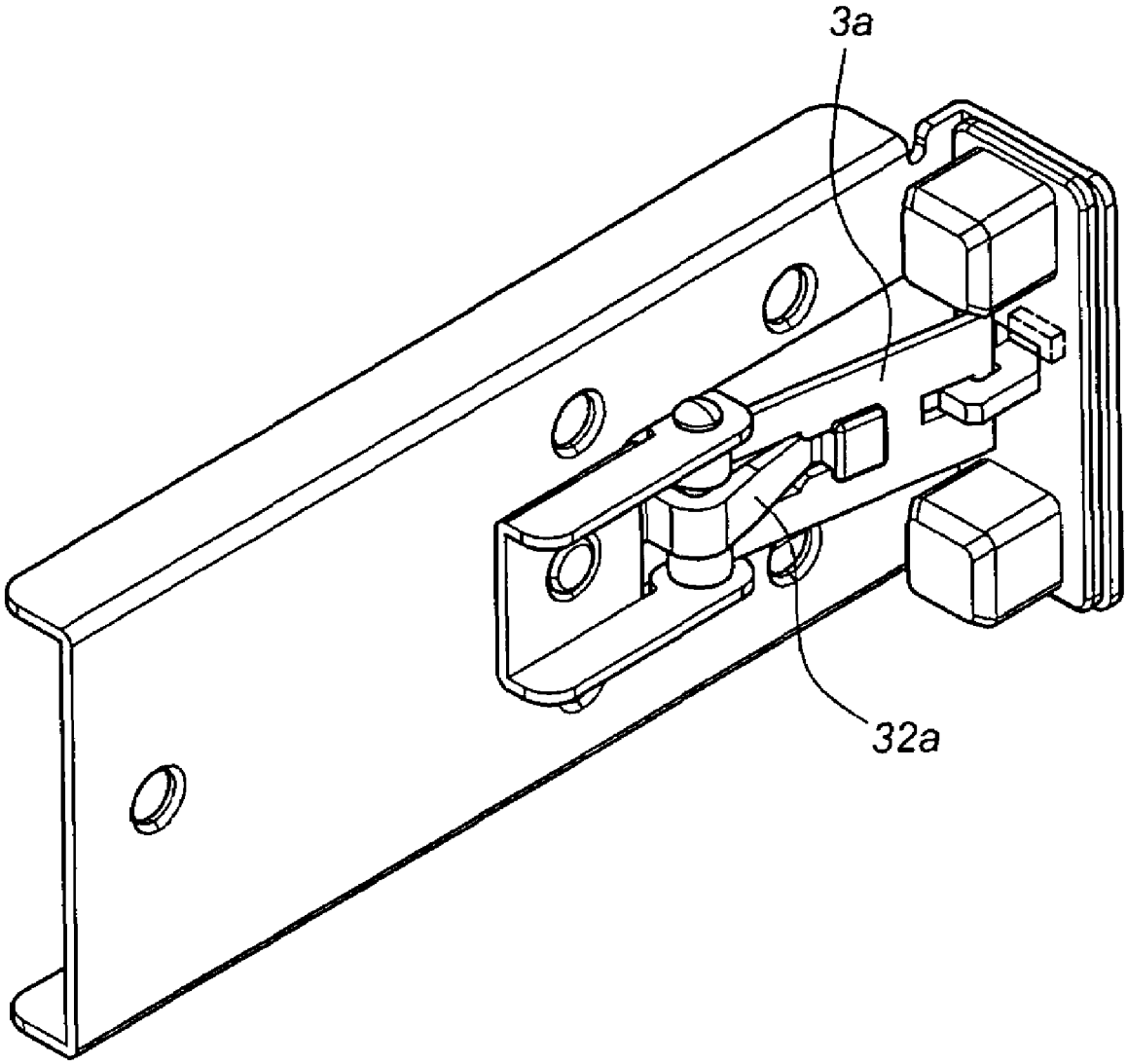
FIG. 2 is a schematic view of a resilient member made in strip form in the first preferred embodiment of the present invention.
Figure 3:
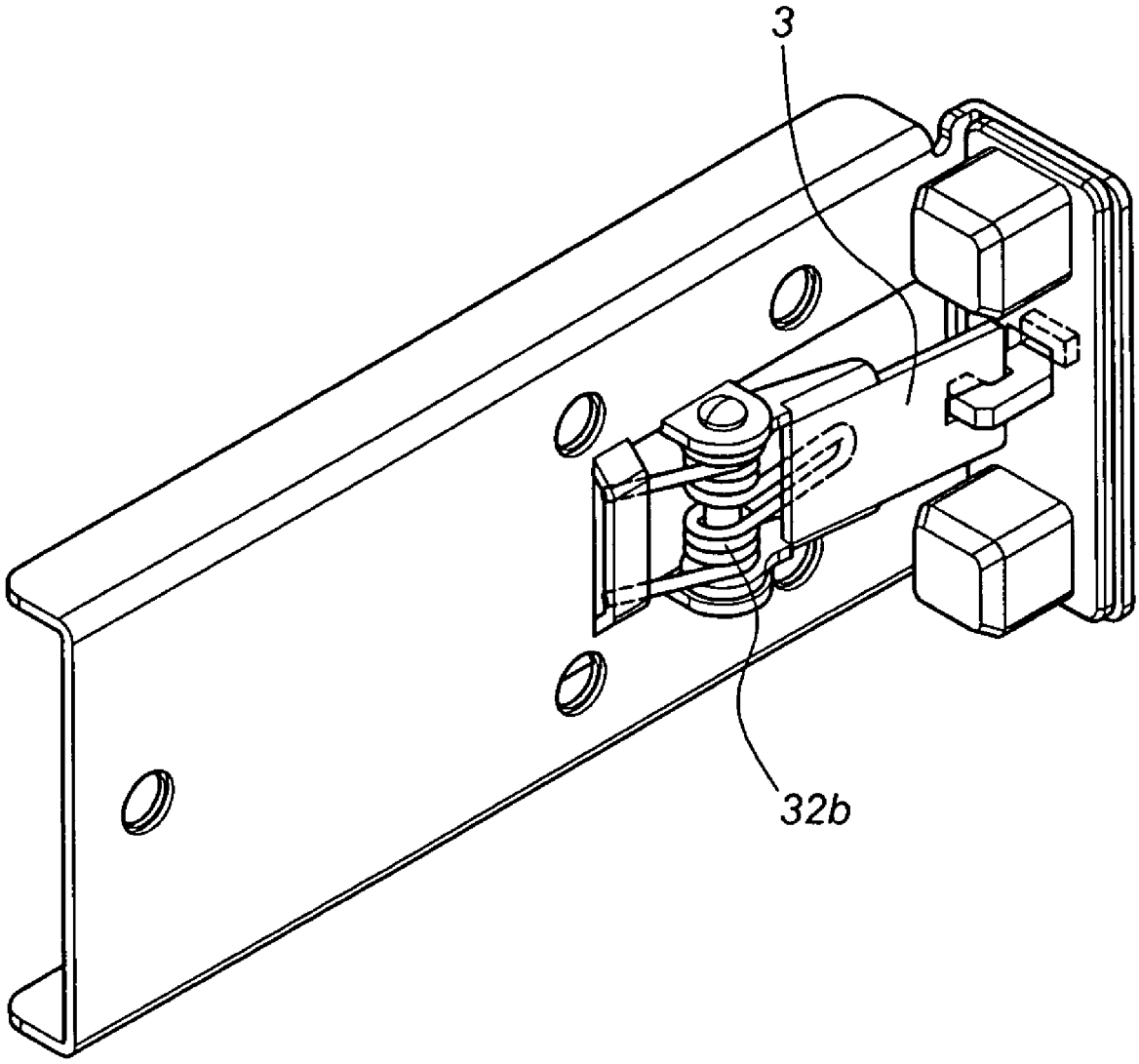
FIG. 3 is a schematic view of a resilient member made in a torsion spring form in the first preferred embodiment of the present invention.

As illustrated in FIG. 2, a resilient member (32*a*) is made in a strip form to compromise a retaining member (3*a*); or alternatively as illustrated in FIG. 3, a resilient member (32*b*) is a torsion spring.

Figure 4:
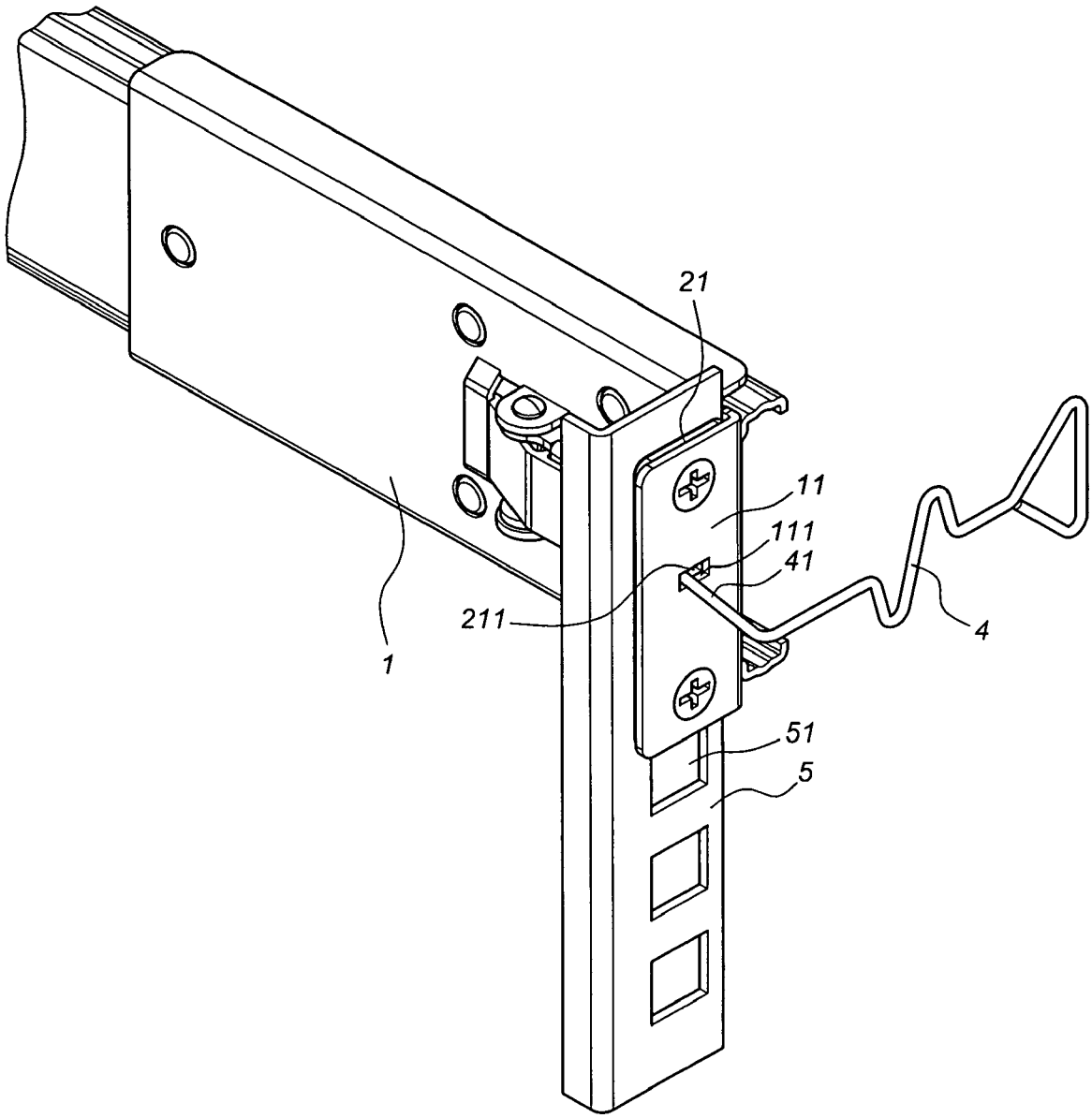
FIG. 4 is a front view showing that a bracket fixed to a support is released in the first preferred embodiment of the present invention by inserting a releasing member into a slot.

Accordingly, when the bracket (1) has the suspension blocks (2) inserted into mounting holes (51) of a support (5) and to secure in the support (5) with the locating end (31) of the retaining member (3) holding against the support (5). To remove the bracket (1) as illustrated in FIGS. 4 and 5, the shank (41) of the releasing member (4) penetrates the slot (111) of the end plate (11) and the slot (211) of the connection plate (21) for the terminal of the shank (41) to hold against the locating end (31) of the retaining member (3).

Figure 5:
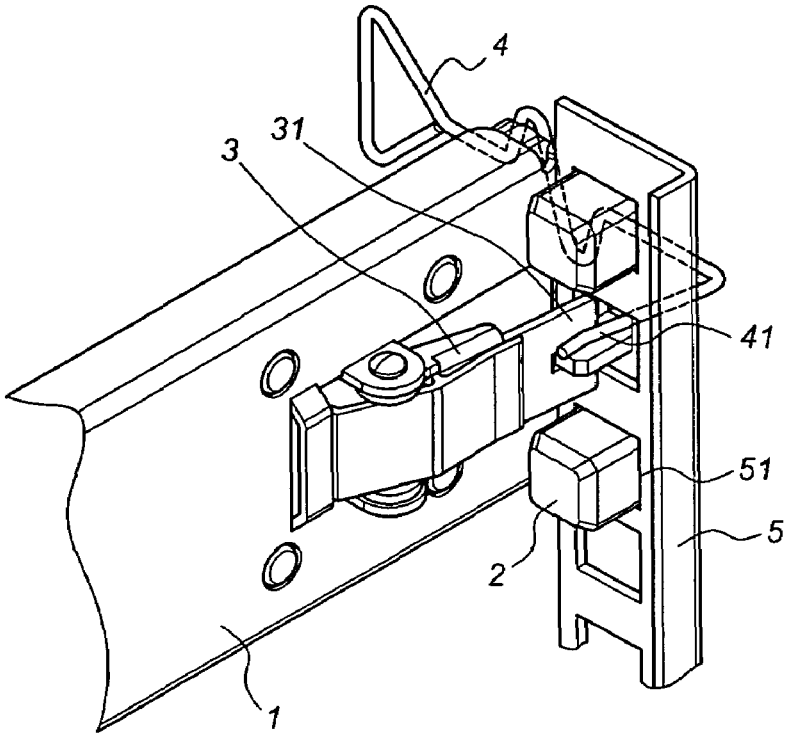
FIG. 5 is another schematic view showing that a bracket fixed to a support is released in the first preferred embodiment of the present invention with the releasing member not yet pressed.
Figure 6:
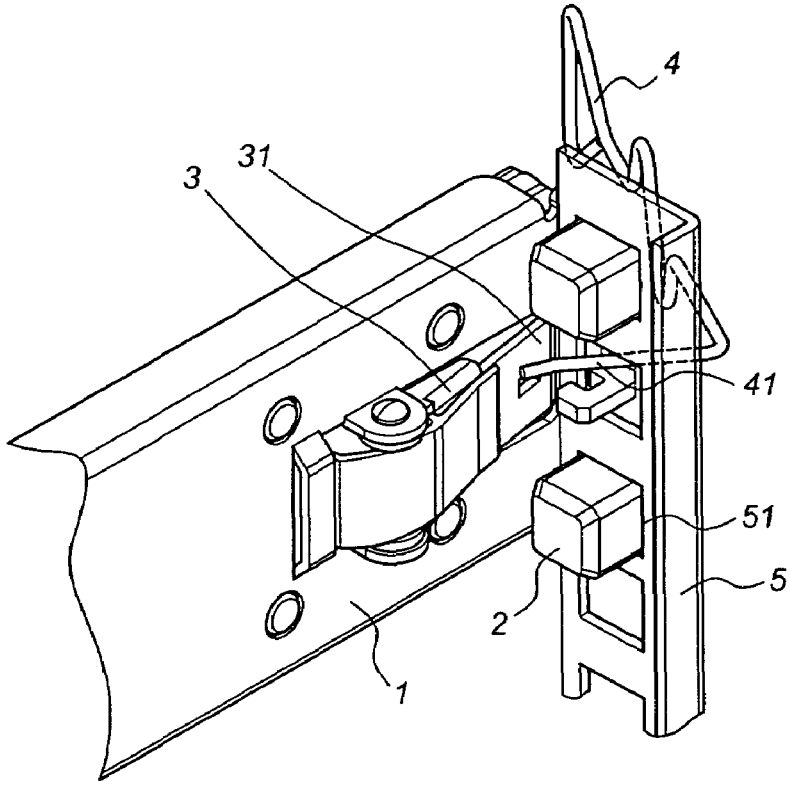
FIG. 6 is another schematic view showing that a bracket fixed to a support is released in the first preferred embodiment of the present invention with the releasing member pressed.

The releasing member (4) is pressed to move the locating end (31) of the retaining member (3) toward the side of the bracket (1) thus to clear off the support (5) to release the fixation between the bracket (1) and the support (5) as illustrated in FIGS. 5 and 6.

Figure 7:
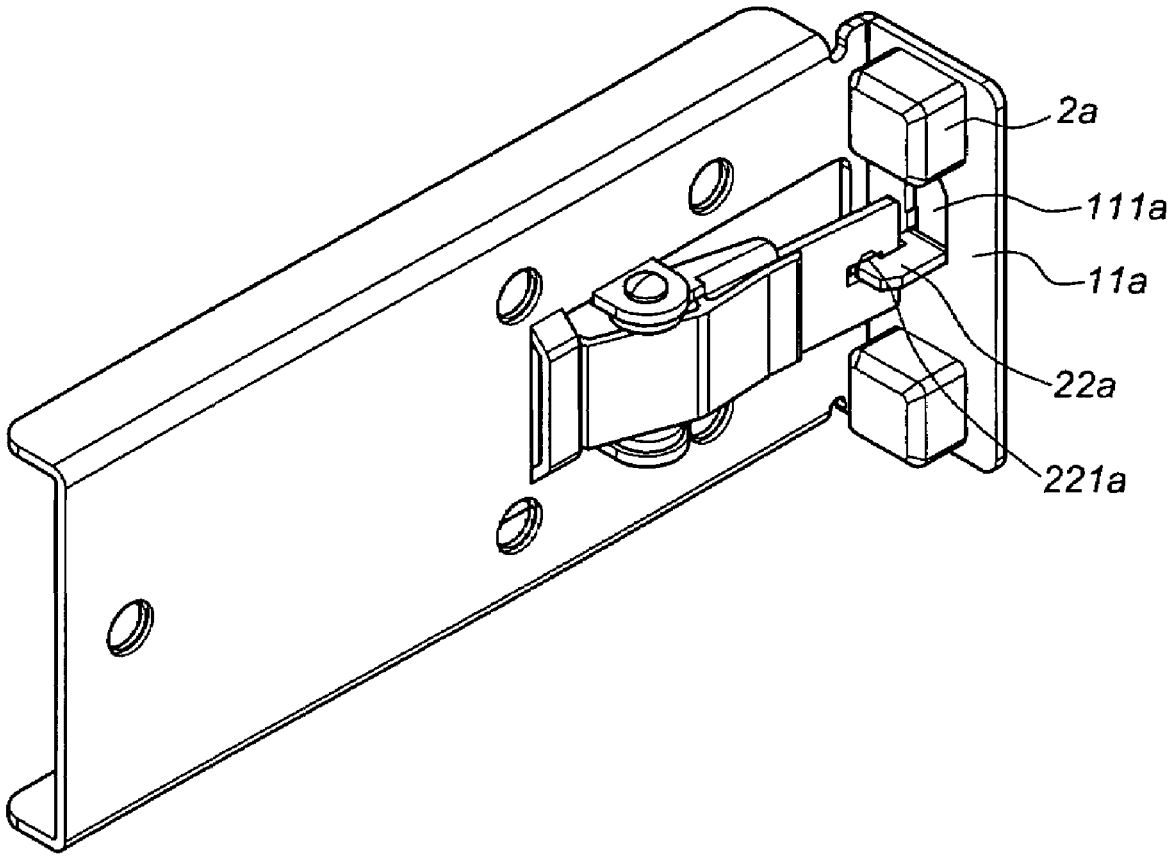
FIG. 7 is a perspective view of a second preferred embodiment of the present invention.

A second preferred embodiment of the present invention as illustrated in FIG. 7 differs from the first preferred embodiment in that at least two suspension blocks (2*a*) are respectively fixed to an upper and a lower portions of the rear part of an end plate (11*a*); a limiting member (22*a*) is disposed at the center of the end plate (11*a*); the terminal of the limiting member (22*a*) is disposed with a hooking part (221*a*); the limiting member (22*a*) is a bending part of the end plate (11*a*) and a slot (111*a*) is directly formed at where the end plate (11*a*) is bent to form the limiting member (22*a*).

Figure 8:
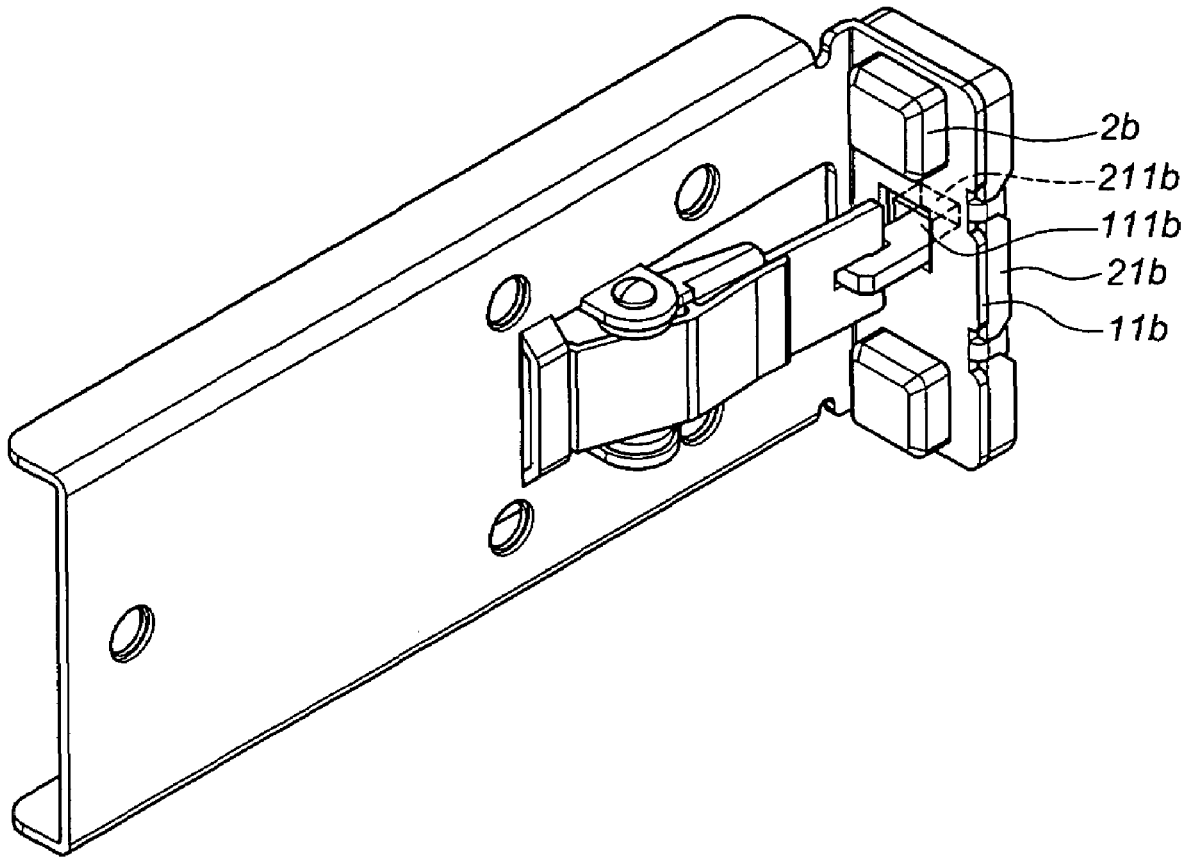
FIG. 8 is a perspective view of a third preferred embodiment of the present invention.

A third preferred embodiment of the present invention as illustrated in FIG. 8 differs from the first and the second preferred embodiments in that at least two suspension blocks (2*b*) are provided; a connection plate (21*b*) is disposed between two neighboring suspension blocks (2*b*); the connection plate (21*b*) is attached to the front part of an end plate (11*b*); and the suspension blocks (2*b*) respectively penetrating through an upper and a lower portions of the end plate (11*b*); and the connection plate (21*b*) is disposed with a slot (211*b*) in relation to a slot (111*b*) disposed at the center of the end plate (11*b*).

The suspension blocks (2*a*) of the second preferred embodiment and the suspension blocks (2*b*) of the third preferred embodiment may be made in cylindrical form.

Figure 9:
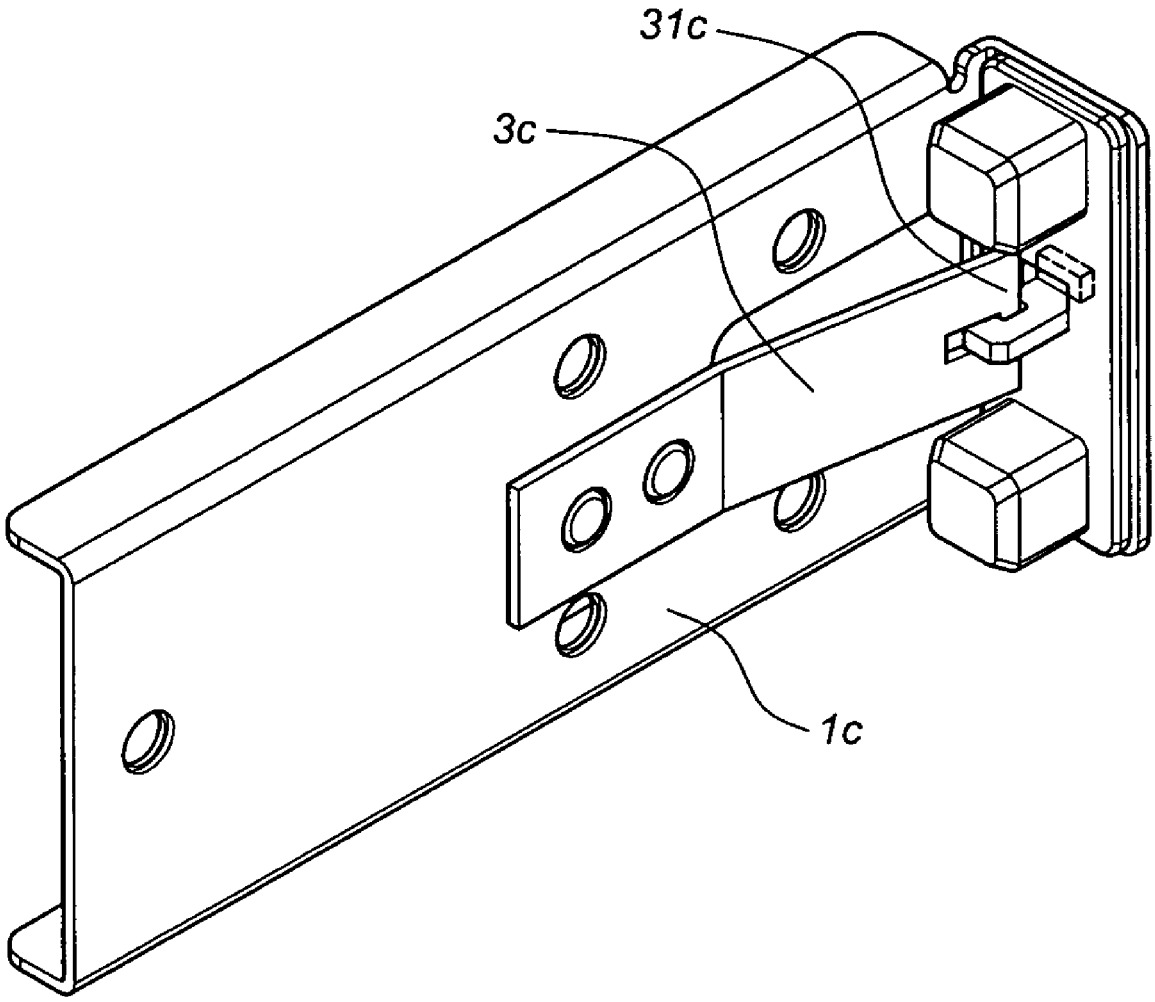
FIG. 9 is a perspective view showing another preferred embodiment of a retaining member of the present invention.

A retaining member (3*c*) as illustrated in FIG. 9 is a resilient member having one end fixed to a bracket (1*c*) and another end as a locating end (31*c*). The locating end (31*c*) is capable of executing resilient motion.

What is claimed is:

1. A slide bracket allowing front access for dismounting, comprising:

an end plate having a front part and a rear part-opposite to each other, a slot penetrating through the end plate, suspension blocks being provided at the rear part of the end plate, the suspension blocks being disposed on a connection plate, the connection plate having a slot corresponding to the slot of the end plate;

a retaining member having a locating end facing in the direction of the rear part of the end plate;

a limiting member provided at the rear part of the end plate; and a releasing member having a shank to pass through the slot of the end plate and the slot of the connection plate, a terminal end of the shank holding against the locating end of the retaining member.

2. The slide bracket allowing front access for dismounting as claimed in claim 1, wherein at least two suspension blocks are provided with the connection plate disposed between two neighboring suspension blocks.

3. The slide bracket allowing front access for dismounting as claimed in claim 2, wherein the limiting member is disposed on the connection plate facing in the direction of the retaining member, the locating end of the retaining member holding against the limiting member.

4. The slide bracket allowing front access for dismounting as claimed in claim 1, wherein the limiting member is disposed on the end plate facing in the direction of the retaining member, the locating end of the retaining member holding against the limiting member.

5. The slide bracket allowing front access for dismounting as claimed in claim 1, wherein the limiting member is disposed with a hooking part, and the locating end of the retaining member is disposed with a hole to engage the hooking part.

6. The slide bracket allowing front access for dismounting as claimed in claim 1, wherein the retaining member is pivotally connected to the slide bracket and connected with a resilient member for the retaining member to swing and rebound.

7. The slide bracket allowing front access for dismounting as claimed in claim 1, wherein the retaining member is fixed to the slide bracket, and the retaining member is resilient to enable the locating end to execute resilient motion.

* * * * *